US010711795B2

(12) United States Patent
Post et al.

(10) Patent No.: US 10,711,795 B2
(45) Date of Patent: Jul. 14, 2020

(54) COVER ASSEMBLY, BLOWER ASSEMBLY AND ASSOCIATED METHOD

(71) Applicant: Regal Beloit America, Inc., Beloit, WI (US)

(72) Inventors: Steven Wilfred Post, Cassville, MO (US); Michael Kenneth Garrett, Cassville, MO (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 268 days.

(21) Appl. No.: 15/612,025

(22) Filed: Jun. 2, 2017

(65) Prior Publication Data

US 2018/0030997 A1 Feb. 1, 2018

Related U.S. Application Data

(60) Provisional application No. 62/367,292, filed on Jul. 27, 2016.

(51) Int. Cl.
*F24H 1/20* (2006.01)
*F04D 29/42* (2006.01)
(Continued)

(52) U.S. Cl.
CPC ..... *F04D 29/4206* (2013.01); *F04D 25/06* (2013.01); *F04D 29/083* (2013.01); *F04D 29/281* (2013.01); *F04D 29/4213* (2013.01); *F04D 29/4226* (2013.01); *F04D 29/626* (2013.01); *F23J 13/00* (2013.01);
(Continued)

(58) Field of Classification Search
CPC ..... F04D 29/4206; F04D 29/4226; F04D 29/4213; F04D 29/626; F04D 29/281; F04D 29/083; F04D 25/06; F24H 9/0026; F24H 1/205–206; F24H 9/02; F24H 1/186;
(Continued)

(56) References Cited

U.S. PATENT DOCUMENTS 2,379,227 A 6/1945 Gibbs et al.
4,397,296 A * 8/1983 Moore, Jr. ..... F24D 17/0068 122/14.22
(Continued)

FOREIGN PATENT DOCUMENTS

EP 1087138 B1 10/2003
EP 2746586 A1 6/2014
IN 200802824 I4 2/2010

*Primary Examiner* — Charles G Freay
*Assistant Examiner* — Thomas Fink
(74) *Attorney, Agent, or Firm* — Armstrong Teasdale LLP

(57) ABSTRACT

A blower assembly is attached to a water heater having an exhaust opening, the assembly includes a tank cap attached to a tank of the heater. A recess surface formed in the exterior surface of the cap. A member has a first surface that is connected to the tank cap to form a cover plenum between the cap and the member. The blower includes a motor, an air moving member connected to the motor and a blower housing having an interior containing the fan. The blower housing has an input opening that communicates the blower housing interior with the member output opening. The blower housing, the member and the tank cap provide an exhaust gas flow path from the exhaust opening of the heater through the cover plenum, through the blower housing interior and out the output opening.

11 Claims, 9 Drawing Sheets

(51) Int. Cl.

| | |
|---|---|
| ***F23M 9/00*** | (2006.01) |
| ***F23L 17/00*** | (2006.01) |
| ***F24H 9/00*** | (2006.01) |
| ***F04D 25/06*** | (2006.01) |
| ***F04D 29/08*** | (2006.01) |
| ***F04D 29/28*** | (2006.01) |
| ***F04D 29/62*** | (2006.01) |
| ***F23J 13/00*** | (2006.01) |

(52) U.S. Cl.
CPC ..... *F23L 17/005* (2013.01); *F23M 9/003* (2013.01); *F24H 1/205* (2013.01); *F24H 1/206* (2013.01); *F24H 9/0026* (2013.01)

(58) Field of Classification Search
CPC .... F24H 1/0027; F23M 9/003; F23M 17/005; F23J 13/00
See application file for complete search history.

(56) References Cited

U.S. PATENT DOCUMENTS 4,531,509 A * 7/1985 Wilhelm, Jr. ..... F24H 1/205 122/18.31
4,856,982 A 8/1989 Olson
5,039,006 A 8/1991 Habegger
5,352,099 A 10/1994 Anstine et al.
5,526,776 A 6/1996 Fenn et al.
5,893,341 A 4/1999 Cox
6,602,058 B1 * 8/2003 Stewart ..... F04D 25/082 417/366
7,250,870 B1 7/2007 Viner et al.
7,354,244 B2 * 4/2008 Hasbargen ..... F23L 17/005 415/212.1
8,210,132 B2 7/2012 Asakura et al.
8,513,839 B1 8/2013 Larson et al.
9,513,003 B2 12/2016 Watanabe et al.
9,618,948 B2 4/2017 Yamaguchi et al.
2001/0027756 A1 * 10/2001 Vago ..... F23D 14/66 122/18.2
2001/0038794 A1 * 11/2001 Stewart ..... F04D 25/082 417/53
2002/0162517 A1 * 11/2002 Carlton ..... F23L 17/04 122/14.2
2007/0095339 A1 5/2007 Lyons et al.
2007/0125361 A1 6/2007 Black et al.
2009/0084328 A1 * 4/2009 Lyons ..... F23C 7/02 122/13.01
2009/0188447 A1 8/2009 Lutz
2009/0211540 A1 * 8/2009 Yin ..... F24H 1/205 122/18.3
2010/0303646 A1 * 12/2010 Garrett ..... F04D 29/441 417/321
2011/0308481 A1 * 12/2011 Gordon ..... F23L 11/02 122/18.1
2012/0174878 A1 * 7/2012 English ..... F24H 1/205 122/18.4
2012/0180737 A1 * 7/2012 English ..... F24H 9/0031 122/18.31
2013/0247843 A1 * 9/2013 Gordon ..... F24H 1/206 122/14.21
2014/0170962 A1 6/2014 Carter et al.
2015/0176861 A1 * 6/2015 Karaki ..... F24H 8/006 122/18.4
2015/0241088 A1 * 8/2015 Kameyama ..... F24H 8/00 110/162
2016/0069587 A1 * 3/2016 Fukunishi ..... F24H 1/124 122/18.4
2017/0350620 A1 * 12/2017 Lesage ..... F24H 9/06
2017/0363322 A1 * 12/2017 Post ..... F24H 9/0031
2017/0363323 A1 * 12/2017 Post ..... F23L 5/02

* cited by examiner

COVER ASSEMBLY, BLOWER ASSEMBLY AND ASSOCIATED METHOD

CROSS REFERENCE TO RELATED APPLICATION

This application is a non-provisional application and claims priority to U.S. Provisional Patent Application 62/367,292 filed Jul. 27, 2016, for "Cover Assembly, Blower Assembly and Associated Method", which is hereby incorporated by reference in its entirety.

BACKGROUND OF THE INVENTION

1. Field of the Invention

The present invention pertains to a heater blower apparatus that is primarily intended for use as a non-dilution water heater blower. The apparatus is designed to provide a low cost high efficiency water heater or to replace an existing water heater or to retrofit an existing water heater between the axially aligned heater exhaust opening and a flue pipe with a more efficient heater.

2. Description of the Related Art

In the basic construction of a water heater, a fuel such as gas is burned in a combustion chamber of the water heater to heat water passed through the water heater. The water typically travels through a flue tube and baffle in the water heater. Combustion of the fuel in the combustion chamber produces hot combustion exhaust gas that passes through the baffle and heats the water passing on the outside of the flue tube. The combustion exhaust gas then exits the water heater through an exhaust opening of the water heater and then passes through a flue pipe that conducts the gas out of the building containing the water heater.

Many prior art water heaters are connected to a flue pipe or chimney where only the draft effect of the flue pipe or chimney moves the exhaust gas up through the flue pipe or chimney. Because only the difference in temperature and pressure between the hot exhaust gas inside the water heater and the ambient air outside the water heater would cause the gas to move upwardly through the flue pipe or chimney, prior art water heaters were designed to avoid restricting the flow of the exhaust gas upwardly through the water heater to ensure that the gas would exit the water heater through the flue pipe or chimney. This limited the baffle restriction that could be positioned inside the water heater so as not to overly restrict the flow of the exhaust gas through the water heater. This in turn reduced the efficiency of the water heater.

To increase efficiency, water heaters have been designed where the hot gas of combustion is drawn through a more rigorous baffle in the water heater to provide an increased amount of heat transfer from the heat of the gas to the water passing through the coils. A more rigorous baffle in the water heater enables a greater amount of heat transfer. However, this also required that the water heater be constructed with a blower apparatus that would draw the combustion gas through the baffle of the water heater and to the flue pipe exhausting the gas.

The addition of a blower apparatus to a water heater increased the overall cost of the water heater. In addition, because the flue gases being drawn into the blower apparatus are greater than 300 degrees Fahrenheit, it is often required that the blower apparatus mix ambient dilution air with the hot exhaust gas to cool the gas. The need to draw dilution air into the blower apparatus to cool the exhaust gas often required that the blower apparatus have a more complicated blower housing design and a more powerful motor for the fan of the apparatus. The more complicated blower housing design often increased the cost of manufacturing the blower apparatus, detracting from the energy savings of the dilution blower apparatus. The energy used by the more powerful motor also would negate some of the energy savings realized by increasing the heat transfer between the combustion gas and the coils of the water heater.

The present invention is directed to alleviate at least some of these problems with the prior art.

BRIEF DESCRIPTION OF THE INVENTION

What is needed to overcome the problems experienced with prior art blower apparatus employed with water heaters is a blower apparatus having a more simplified housing construction that can be manufactured inexpensively. In addition, the blower apparatus should be a non-dilution type to avoid the increased cost of a more complicated blower housing design and a more powerful motor for the apparatus. With the apparatus being non-dilution, the apparatus housing should be able to withstand the high heat of combustion exhaust gas drawn into the housing. Furthermore, the blower housing construction must enable the apparatus to be retrofit between an existing heater exhaust opening and an existing flue pipe that exhausts the combustion gas of the heater. Still further, to facilitate retrofitting the heater blower apparatus between an existing heater exhaust opening and flue pipe, the vertical height dimensions of the blower housing must be minimized. Although it is necessary that the blower housing have a limited height dimension, it is also desirable that the blower housing restrict the free flow of heat from the water heater up through the exhaust flue pipe when the water heater is in a standby mode and water is not circulating through the water heater.

The heater blower apparatus of the present invention utilizes the cap of a water heater to serve as a cover plenum to assist in the collection and direction of exhaust gases from a burner after they have risen up the flue tube to the exhaust of the heater. The apparatus provides for both a lower profile for the water heater as well as to provide a lower cost heater as the water heater cap can serve two purposes, to cover the top of the water heater and to provide a cover plenum that otherwise would need to be designed into the housing of the heater blower or to be added as a separate device positioned between the cap and the heater blower housing. Alternatives to the recessed cap which forms the cover plenum of the present invention add cost to the water heater and make the overall height of the water greater. The greater height may prevent the use of this more efficient water heater being used to replace a water heater in an existing installation.

The heater blower apparatus of the present invention is designed to be retrofit to a heater, for example a water heater, between the existing heater exhaust opening and a flue pipe. The apparatus has a blower housing of novel construction that facilitates the insertion of the apparatus between an axially aligned heater exhaust opening and a flue pipe. In addition, the novel construction of the blower housing has an interior exhaust gas flow path that changes direction as it extends through the interior of the blower housing, and thereby significantly reduces standby energy losses from the water heater.

The blower housing in the preferred embodiment is a non-dilution blower housing constructed of only two parts. Also in the preferred embodiment, a first part and a second part of the blower housing are formed of stamped or drawn sheet metal, thereby reducing their cost of manufacture and providing a non-dilution blower housing that can withstand the increased heat of combustion gas drawn into the housing. The first part of the housing is formed with one side positioned in a single plane that facilitates the mounting and sealing of the one side on an exterior surface of a heater such as a water heater. The first part of the housing is also dimensioned to extend over the exhaust opening of the water heater, positioning the exhaust opening in the interior of the first part of the housing. There are no dilution openings or vent openings to the housing first part. This maximizes the ability of the blower housing to generate a negative pressure to draw exhaust gases through the heater and into the blower housing.

The housing second part is designed to be attached on top of the housing first part, thereby completing the construction of the blower housing. The housing second part can be attached to the housing first part by threaded fasteners, by sealants or adhesives, or by other equivalent means. With the housing second part attached on top of the housing first part, the assembled blower housing encloses an interior having internal structure that creates a winding exhaust gas flow path through the blower housing. The construction of the housing second part includes the output opening of the blower housing. The output opening is generally positioned axially above and at least partially overlaps the heater exhaust opening when the blower housing is assembled to the exterior of the heater over the exhaust opening flue.

The internal structure of the blower housing includes an interior wall that is formed by the housing first part. The interior wall extends through the blower housing interior and divides the interior into a first portion that communicates with the heater exhaust opening and a second portion that communicates with the blower housing output opening. An additional opening is provided through the interior wall. The additional opening is spaced out of alignment with the heater exhaust opening and the blower housing output opening, thereby creating the winding path of exhaust gas flow through the blower housing interior.

The interior wall is also formed with a recessed cavity. The opening through the interior wall is positioned in the recessed cavity. The recessed cavity is dimensioned to receive at least a portion of a fan inside the cavity. This enables the blower housing to contain the fan in the interior of the blower housing while also enabling a reduction in the overall vertical height dimension of the blower housing on the exterior surface of the heater.

The second part of the blower housing supports a motor. The motor is positioned on the housing second part with a shaft of the motor extending into the blower housing to the fan contained in the blower housing interior. Operation of the motor rotates the fan in the blower housing. Rotation of the fan draws exhaust gas through the heater exhaust opening, then through the first portion of the blower housing interior, then through the opening in the blower housing interior wall to the fan, and then pushes the exhaust gas through the second portion of the blower housing interior to the output opening of the blower housing. The gas is then forced through the blower housing output opening to the flue pipe connected to the blower housing.

The circuitous or winding path of the exhaust gas through the interior of the blower housing reduces standby losses from the heater to which the blower apparatus is attached. In addition, a damper could be added to the interior of the blower housing to further reduce standby losses of the heater.

Thus, the novel construction of the blower housing of the invention enables the positioning of an interior wall in the blower housing to create the winding path for exhaust gas flow to reduce standby losses, and, also, enables positioning the fan in the blower housing while limiting the vertical height dimension of the blower housing.

Furthermore, the novel construction enables the blower housing to be retrofit or assembled to an exterior surface of a heater over the exhaust opening of the heater and between the existing exhaust opening and a flue pipe.

Still further, the desirable features of the blower housing are attained by providing a housing of only two-piece construction that in the preferred embodiment are stamped or drawn from metal sheet, thereby reducing the overall costs involved in the construction of the blower housing.

According to an embodiment of the invention, a tank cap assembly for use with a water heater having an exhaust opening on the exterior surface of the water heater is provided. The tank cap assembly is adapted to be positioned between a water heater tank and a heater blower assembly, said tank cap assembly includes a body having a recess surface formed in the exterior surface of the body and a member.

The member defines a first surface of the member. The member is connected to the tank cap to form a cover plenum between the recess surface of the cap and the first surface of the member. The cover plenum is in communication with the exhaust opening of the water heater. The member defines an output opening of the member that communicates the cover plenum with the heater blower assembly. The member and the tank cap provide an exhaust gas flow path from the exhaust opening of the water heater through the cover plenum, and through the heater blower assembly.

According to an aspect of the present invention, the tank cap assembly may be provided wherein the body and the member are integral with each other.

According to another aspect of the present invention, the tank cap assembly may be provided wherein the heater blower assembly includes a blower housing and wherein the member and the blower housing are integral with each other.

According to another aspect of the present invention, the tank cap assembly may be provided wherein the water heater includes a water heater tank and wherein the body and the water heater tank are integral with each other.

According to an aspect of the present invention, the tank cap assembly may be provided wherein the tank cap recess surface extends inwardly toward the heater in the axial direction of the exhaust opening.

According to another embodiment of the invention, a blower assembly that is attachable to a water heater having an exhaust opening on the exterior surface of the water heater is provided. The assembly includes a tank cap adapted to be attached to a tank of the heater. The cap has a recess surface formed in the exterior surface of the cap and configured to extend inwardly toward the heater in the axial direction of the exhaust opening. The assembly also includes a member defining a first surface of the member and connected to the tank cap to form a cover plenum between the recess surface of the cap and the first surface of the member. The member defines an output opening of the member that communicates the cover plenum with the output opening.

The assembly further includes a blower having a motor, an air moving member connected to the motor for rotation of the fan with rotation of the motor, and a blower housing. The blower housing has an interior containing the fan. The motor is supported by the blower housing. The blower housing has an output opening and an input opening. The input opening communicates the blower housing interior with the cover plenum. The blower housing, the member and the tank cap configured to provide an exhaust gas flow path from the exhaust opening of the heater through the cover plenum, through the blower housing interior and out the output opening.

According to an aspect of the present invention, the blower assembly may be provided wherein the tank cap and the member are integral with each other.

According to another aspect of the present invention, the blower assembly may be provided wherein the tank cap and the blower housing are integral with each other.

According to another embodiment of the invention, a blower assembly that is attachable to a water heater having an exhaust opening on the exterior surface of the water heater is provided. The assembly includes a tank cap adapted to be attached to a tank of the heater. The cap has a recess surface formed in the exterior surface of the cap. The assembly also includes a member defining a first surface of the member and connected to the tank cap to form a cover plenum between the recess surface of the cap and the first surface of the member. The member defines an output opening of the member that communicates the cover plenum with the output opening. The assembly also includes a blower having a motor, an air moving member connected to the motor for rotation of the fan with rotation of the motor, and a blower housing.

The blower housing has an interior containing the fan. The motor is supported by the blower housing. The blower housing has an output opening and an input opening that communicates the blower housing interior with the member output opening. The blower housing, the member and the tank cap configured to provide an exhaust gas flow path from the exhaust opening of the heater through the cover plenum, through the blower housing interior and out the output opening.

According to another aspect of the present invention, the blower assembly may be provided wherein the tank cap and the member are integral with each other.

According to another aspect of the present invention, the blower assembly may be provided wherein the tank cap and the blower housing are integral with each other.

According to another aspect of the present invention, the blower assembly may be provided wherein the tank cap recess surface extends inwardly toward the heater in the axial direction of the exhaust opening.

According to another embodiment of the present invention, blower assembly may be provided wherein the blower assembly is attachable to a water heater having an exhaust opening on the exterior surface of the water heater with the exhaust opening having a center axis that defines mutually perpendicular axial and radial directions relative to the heater and advances exhaust gases from the heater to an exterior environment.

The assembly includes a tank cap adapted to be attached to a tank of the heater. The cap has a recess surface formed in the exterior surface of the cap. The recess surface is configured to extend inwardly toward the heater in the axial direction of the exhaust opening. The assembly includes a member defining a first surface of the member and connected to the tank cap to form a cover plenum between the recess surface of the cap and the exterior surface of the member. The member defines an output opening of the member that communicates the cover plenum with the output opening.

The assembly also includes a blower having a motor, a fan connected to the motor for rotation of the fan with rotation of the motor and a blower housing. The blower housing has an interior containing the fan. The motor is supported by the blower housing. The blower housing has an output opening having a center axis that defines mutually perpendicular axial and radial directions and that communicates the blower housing interior with the exterior environment of the blower housing. The blower housing further has an input opening that communicates the blower housing interior with the member output opening. The blower housing, the member and the tank cap are configured to provide an exhaust gas flow path from the exhaust opening of the heater through the cover plenum, through the blower housing interior and out the output opening.

According to another aspect of the present invention, the blower assembly may further include the center axis of the blower housing output opening being substantially parallel to and spaced radially from the motor shaft axis of rotation and the fan axis of rotation. The output opening may be positioned axially above the heater exhaust opening when the blower housing is attached to the member.

According to another aspect of the present invention, the blower assembly may further include the blower housing being attachable to the member or cover to prevent dilution air from entering the blower housing interior.

According to another aspect of the present invention, the blower assembly may further include the blower housing being attachable to the member or cover with the blower housing sealing around the member and thereby providing a non-dilution air blower housing on the heater.

According to another aspect of the present invention, the blower assembly may further include the interior structure of the blower housing including an interior wall that extends radially through the blower housing interior and is positioned axially between the heater exhaust opening and the blower housing output opening when the blower housing is attached to the member.

According to another aspect of the present invention, the blower assembly may further include the interior wall having an opening through the interior wall that is spaced radially and axially from the blower housing output opening and is spaced radially and axially from the heater exhaust opening when the blower housing is attached to the member.

According to another aspect of the present invention, the blower assembly may further include the exhaust gas flow path passing through the interior wall opening.

According to another aspect of the present invention, the blower assembly may further include interior wall opening being axially aligned with the fan axis of rotation.

According to another aspect of the present invention, the blower assembly may further include the fan being positioned on one side of the interior wall and the heater exhaust opening being positioned on an opposite side of the interior wall when the blower housing is attached to the member.

According to another aspect of the present invention, the blower assembly may be provided wherein the tank cap and the member are integral with each other.

According to another aspect of the present invention, the blower assembly may be provided wherein the tank cap and the blower housing are integral with each other.

According to another embodiment of the present invention, a water heater may be provided. The water heater includes a burner and a tank positioned above the burner. The tank has an exhaust opening on the exterior surface of the tank with the exhaust opening having a center axis that defines mutually perpendicular axial and radial directions relative to the heater and advances exhaust gases from the burner to an exterior environment.

The water heater includes a tank cap adapted to be attached to the tank. The cap has a recess surface formed in the exterior surface of the cap and the recess surface extends inwardly toward the tank in the axial direction of the exhaust opening.

The water heater further includes a member defining a first surface thereof and connected to the tank cap to form a cover plenum between the recess surface of the cap and the exterior surface of the member and a blower. The member defines an output opening of the member that communicates the cover plenum with the output opening. The blower includes a motor and a fan connected to the motor for rotation of the fan with rotation of the motor.

The blower also includes a blower housing having an interior containing the fan. The motor is supported by the blower housing. The blower housing has an output opening that has a center axis that defines mutually perpendicular axial and radial directions and that communicates the blower housing interior with the exterior environment of the blower housing. The blower housing further has an input opening that communicates the blower housing interior with the member output opening. The blower housing, the member and the tank cap provide an exhaust gas flow path from the exhaust opening of the tank through the cover plenum, through the blower housing interior and out the output opening.

According to another aspect of the present invention, the water heater may further include the center axis of the blower housing output opening being substantially parallel to and spaced radially from the motor shaft axis of rotation and the fan axis of rotation. The output opening is positioned axially above the heater exhaust opening when the blower housing is attached to the member.

According to another aspect of the present invention, the water heater may further include the blower housing being attachable to the member or cover to prevent dilution air from entering the blower housing interior.

According to another aspect of the present invention, the water heater may further include the blower housing being attachable to the member or cover with the blower housing sealing around the member and thereby providing a non-dilution air blower housing on the heater.

According to another aspect of the present invention, the water heater may further include the interior structure of the blower housing including an interior wall that extends radially through the blower housing interior and is positioned axially between the tank exhaust opening and the blower housing output opening when the blower housing is attached to the member.

According to another aspect of the present invention, the water heater may further include the interior wall having an opening through the interior wall that is spaced radially and axially from the blower housing output opening and is spaced radially and axially from the heater exhaust opening when the blower housing is attached to the member.

According to another aspect of the present invention, the water heater may further include the exhaust gas flow path passing through the interior wall opening.

According to another aspect of the present invention, the water heater may further include the interior wall opening being axially aligned with the fan axis of rotation.

According to another aspect of the present invention, the water heater may further include the fan being positioned on one side of the interior wall and the heater exhaust opening being positioned on an opposite side of the interior wall when the blower housing is attached to the member.

According to another aspect of the present invention, the water heater may be provided wherein the tank cap and the member are integral with each other.

According to another aspect of the present invention, the water heater may be provided wherein the tank cap and said blower housing are integral with each other.

According to another aspect of the present invention, the water heater may further include the motor shaft axis of rotation and fan axis of rotation being substantially coaxial and substantially parallel to the blower housing output opening axis and the heater exhaust opening center axis.

According to another aspect of the present invention, the water heater may further include the interior wall having an opening with a center axis that is substantially coaxial with the fan axis of rotation.

According to another embodiment of the present invention, a method for sealing a blower housing to a duct of a heater may be provided. The method includes the steps of providing a cap, forming a recess in the cap, positioning the cap over the duct, providing a member, positioning the member over the cap to form a cover plenum from the recess between the cap and the member, providing a flow path from the duct to the cover plenum, providing a blower housing having an inlet thereof and providing a flow path from the cover plenum to the inlet of the blower housing.

BRIEF DESCRIPTION OF THE DRAWINGS

Further features of the heater blower apparatus of the invention are set forth in the following detailed description of the preferred embodiment of the apparatus and in the drawing figures.

DETAILED DESCRIPTION OF THE INVENTION

Figure 1:
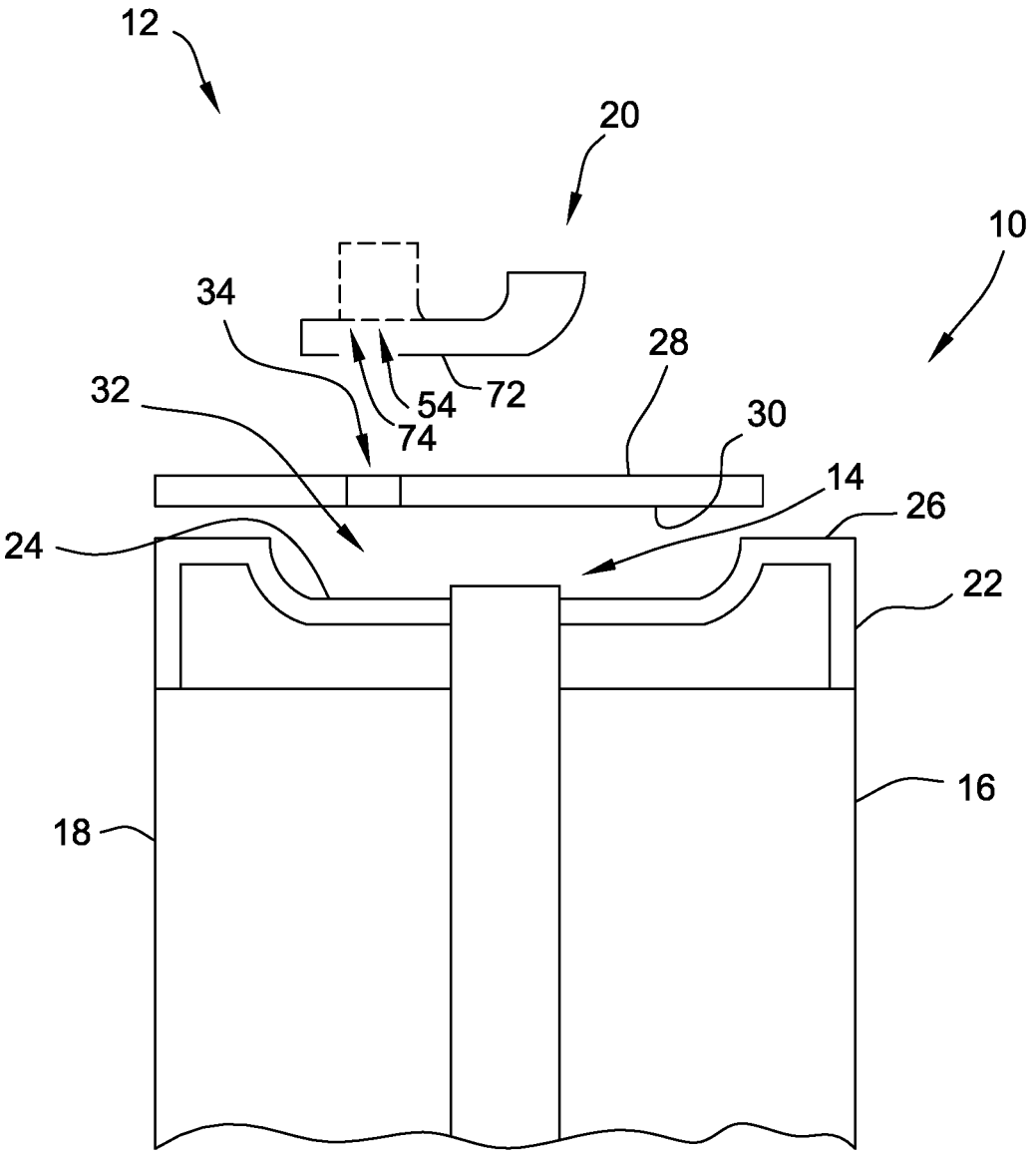
FIG. 1 is a partially exploded plan view, partially in cross section, of a water heater cover assembly according to an embodiment of the present invention.

According to an embodiment of the invention and referring to FIG. 1, a tank cap assembly 10 for use with a water heater 12 having an exhaust opening 14 on the exterior surface 16 of the water heater 12 is provided. The tank cap assembly 10 is adapted to be positioned between a water heater tank 18 and a heater blower assembly 20, said tank cap assembly 10 includes a body or tank cap 22 having a recess surface 24 formed in the exterior surface 26 of the body 22 and a member or cover 28.

The member 28 defines a first surface 30 of the member 28. The member 24 is connected to the tank cap or body 22 to form a cover plenum 32 between the recess surface 24 of the cap 22 and the first surface 30 of the member 28. The cover plenum 32 is in communication with the exhaust opening 14 of the water heater 12.

The member 28 defines an output opening 34 of the member 28 that communicates the cover plenum 32 with the heater blower assembly 20. The member 28 and the tank cap 22 provide an exhaust gas flow path 36 from the exhaust opening 14 of the water heater 12 through the cover plenum 32, and through the heater blower assembly 20.

The tank cap 22 may have any suitable shape and may be shaped to cover top 38 of the tank 18. The cap 22 may be secured to the tank 18 by any suitable method, including but not limited to fasteners (not shown), welding, tape, belts or brackets (not shown), interference fit, or by glue and may alternatively be spaced from the tank.

The tank cap 22 may be made of any suitable material and may, for example, be made of polymer, a metal or a composite material. The tank cap 22 may be made using any suitable manufacturing process. The tank cap 22 may, for example, be molded, cast, fabricated, poured, or machined.

The member 28 may have any suitable shape and may be shaped to fit between the tank cap 22 and the blower assembly 20. The member 28 may be secured to the tank cap 22 and to the blower assembly 20 by any suitable methods, including but not limited to fasteners (not shown), welding, tape, belts or brackets (not shown), interference fit, or by glue.

The member 28 may be made of any suitable material and may, for example, be made of polymer, a metal or a composite material. The member 28 may be made using any suitable manufacturing process. The member 28 may, for example, be molded, cast, fabricated, poured, or machined.

Figure 2:
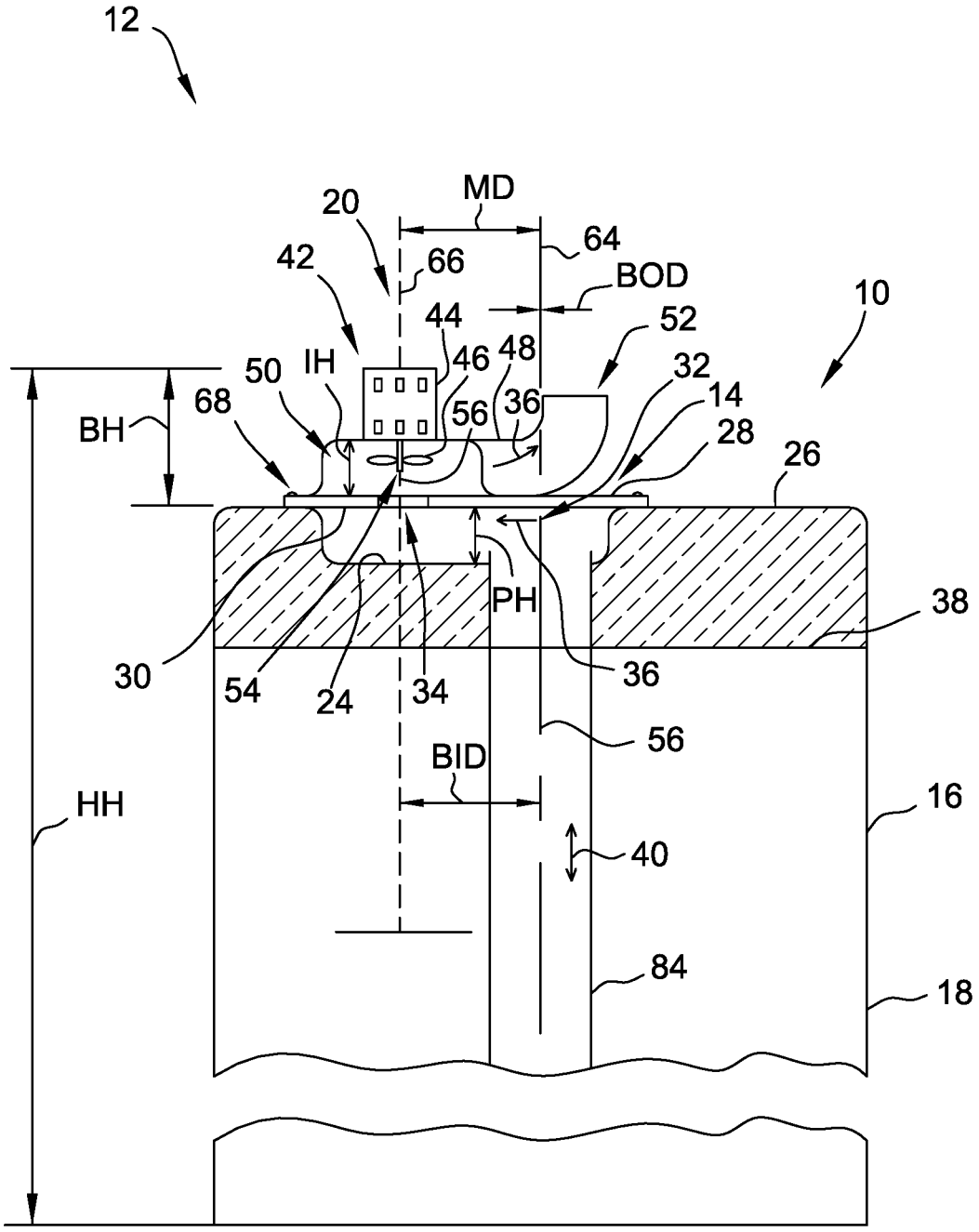
FIG. 2 is a plan view, partially in cross section, of a water heater according to another embodiment of the present invention utilizing the heater cover assembly of FIG. 1.

Referring now to FIG. 2 and according to an aspect of the present invention, the tank cap assembly 10 may be provided wherein the tank cap recess surface 24 extends inwardly toward the heater 12 in the axial direction (arrow 40) of the exhaust opening 14.

Extending the recess surface 24 inwardly in the direction of arrow 40 permits the blower housing assembly 20 to have a lesser blower height BH and thus to have a water heater 12 with an overall heater height HH that is minimal. Locations where water heaters are located, such as basements, may have low ceilings. The less height required using the cap of the present invention, permits the installation of higher efficiency water heaters with heater blower assemblies.

As shown in FIG. 2, the blower housing assembly 20 may include a blower 42 having a motor 44, an air moving member or fan 46 connected to the motor 44 for rotation of the fan 46 with rotation of the motor 44, and a blower housing 48. The blower housing 48 may be of a one-piece construction using the member or cover 28 to assist in enclosing the housing 48. The blower housing 48 has an interior 50 containing the fan 46. The motor 44 is supported by the blower housing 48. The blower housing 48 has an output opening 52 and an input opening 54. The input opening 54 communicates the blower housing interior 50 with the cover plenum 32. The blower housing 48, the member 28 and the tank cap 22 are configured to provide the exhaust gas flow path 36 from the exhaust opening 14 of the heater 12 through the cover plenum 32, through the blower housing interior 50 and out the output opening 52.

Figure 3:
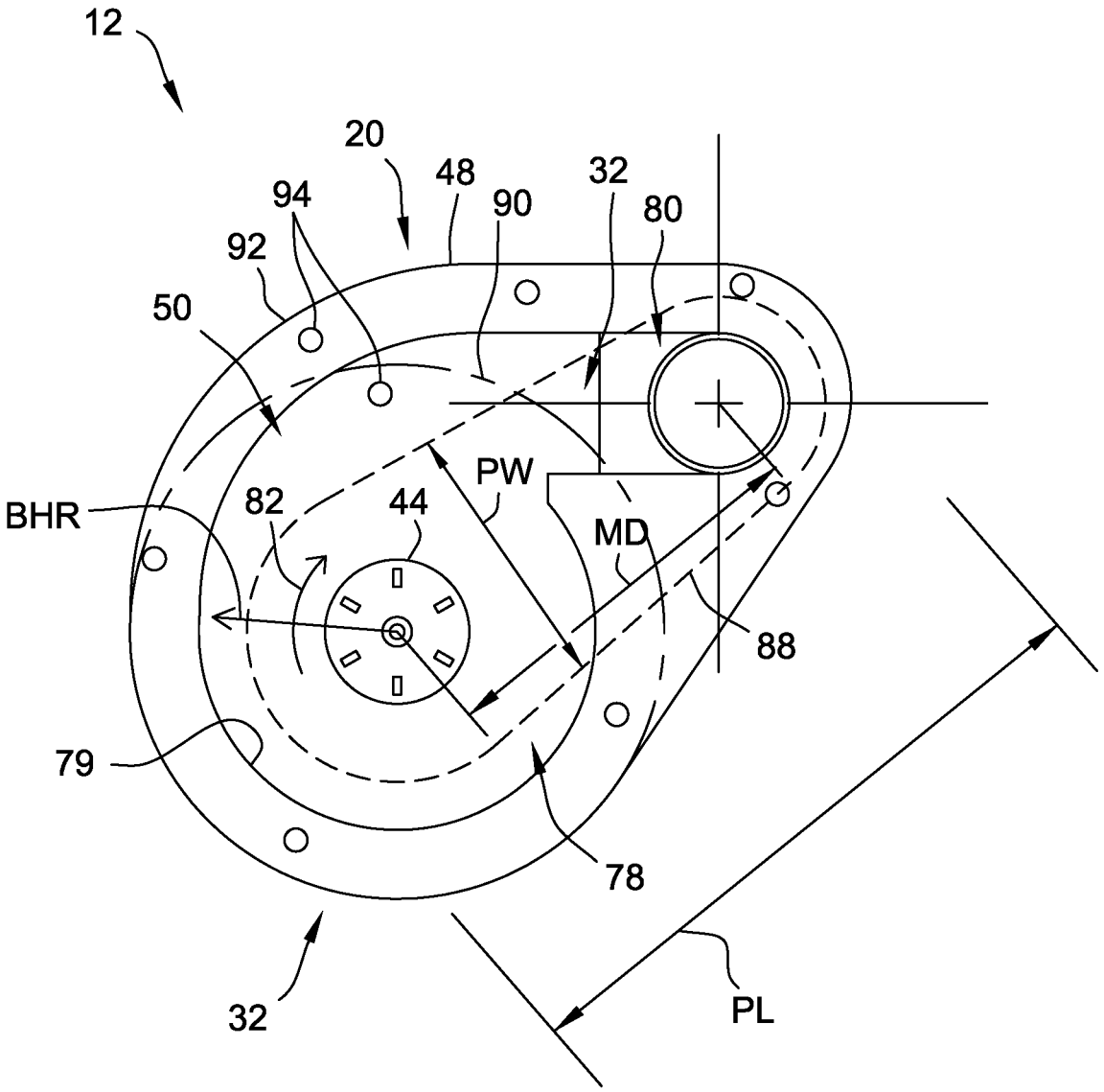
FIG. 3 is a top view, partially in cross section of a furnace blower assembly for use with the water heater of FIG. 2.
Figure 4:
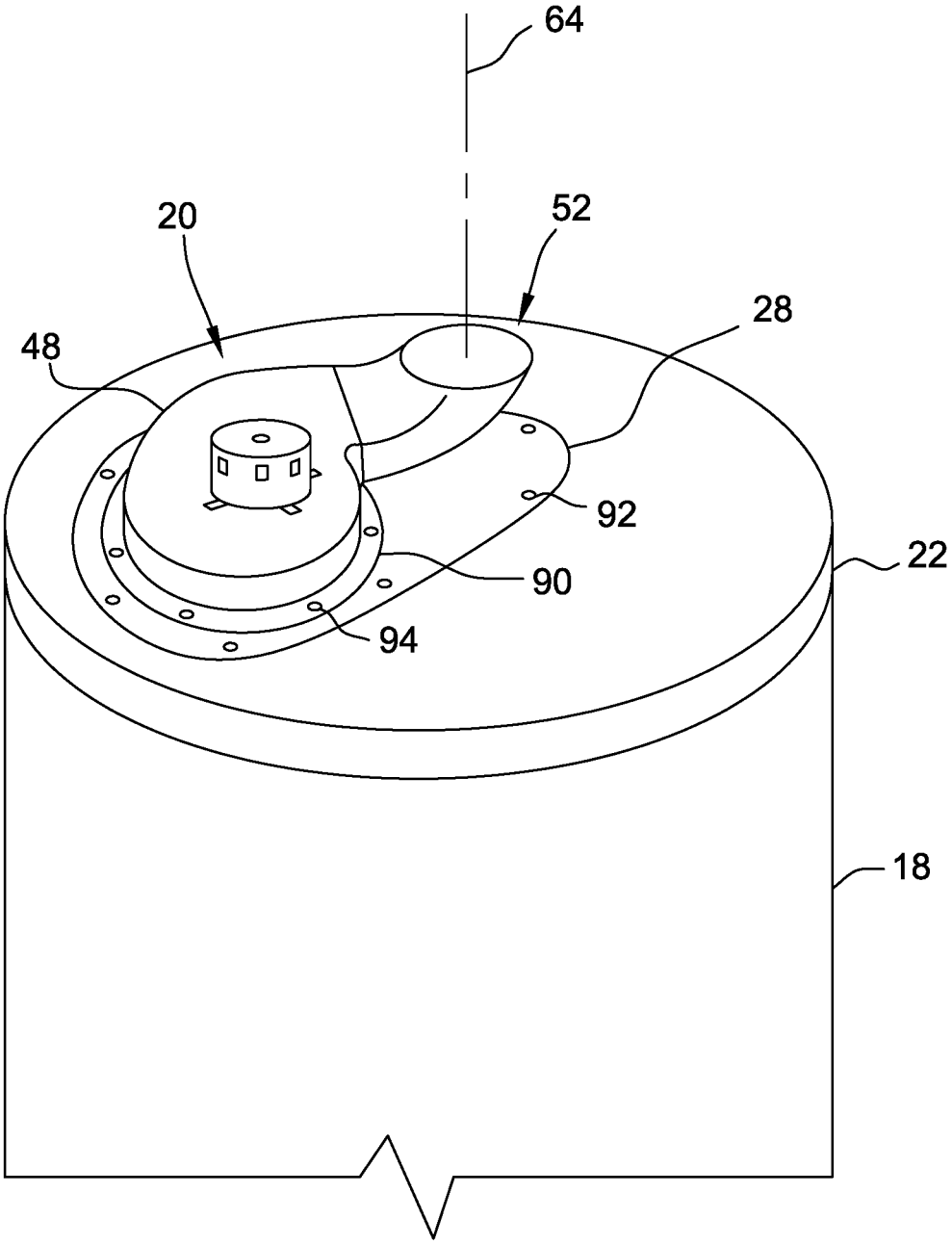
FIG. 4 is a perspective view of the furnace blower assembly of FIG. 3 positioned on the water heater of FIG. 1.

As shown in FIGS. 2-4, the blower assembly 20 may be provided wherein the blower assembly 20 is attachable to the water heater 12 having the exhaust opening 14 on the exterior surface 16 of the water heater 12 with the exhaust opening 14 having a center axis 56 that defines mutually perpendicular axial 58 and radial directions 60 relative to the heater 12 and advances exhaust gases 62 from the heater 12 to an exterior environment 64.

As shown in FIGS. 2-4 and according to another aspect of the present invention, the blower assembly 20 may further include a center axis 64 of the blower housing output opening being substantially parallel to and spaced radially an offset distance ROD from a motor shaft axis of rotation 66 which is coincident with the fan axis of rotation. The output opening 34 of the cover 28 may be positioned axially above the heater exhaust opening 14 when the blower housing 48 is attached to the cover 28.

As shown in FIGS. 2-4 and according to another aspect of the present invention, the blower assembly 20 may further include the blower housing 48 being attachable to the cover 28 to prevent dilution air 68 from entering the blower housing interior 50.

As shown in FIGS. 2-4 and according to another aspect of the present invention, the blower assembly 20 may further include the blower housing 48 being attachable to the cover 28 with the blower housing 48 sealing around upper surface 70 of the cover 28 and thereby providing a non-dilution air blower housing 48 on the heater 12.

As shown in FIGS. 2-4 and according to another aspect of the present invention, the blower assembly 20 may further include the interior structure 50 of the blower housing 48 including an interior wall 72 that extends radially through the blower housing interior 50 and is positioned axially between the heater exhaust opening 14 and the blower housing output opening 52 when the blower housing 48 is attached to the member or cover 28.

As shown in FIGS. 2-4 and according to another aspect of the present invention, the blower assembly 20 may further include the interior wall 72 having an opening 74 through the interior wall that is spaced radially and axially from the blower housing output opening 52 and is spaced radially and axially from the heater exhaust opening 14 when the blower housing 48 is attached to the member or cover 28. The interior wall 72 may define the input opening 54 of the blower assembly 20

According to another aspect of the present invention, the blower assembly 20 may further include the exhaust gas flow path 36 passing through the interior wall opening 74.

According to another aspect of the present invention, the blower assembly 20 may further include interior wall opening 74 being axially aligned with the fan axis of rotation 66.

As shown in FIGS. 2-4 and according to another aspect of the present invention, the blower assembly 20 may further include the fan 46 being positioned on one side of the interior wall 72 and the heater exhaust opening 14 being positioned on an opposite side of the interior wall 72 when the blower housing 48 is attached to the member 28.

As shown in FIGS. 2-4, cover plenum 32, the blower assembly 20, the input opening 54 of the blower assembly, the output opening 52 of the blower assembly and the exhaust opening 14 may be positioned both axial and radially in the locations most suitable for the water heater configuration desired. As shown hi FIGS. 2-4 the blower assembly 20 is positioned axially above the cover plenum 32.

As shown in FIGS. 2-4 the motor 44, the exhaust opening 14, the cover plenum 32, the input opening 54 of the blower assembly and the output opening 52 of the blower assembly may be positioned radially or offset radially with respect to each other. For example, and as shown in FIGS. 2-4, the center axis 56 of the exhaust opening 14 may be in alignment or coincident with the center axis 64 of the blower housing output opening 52. This coincident axes arrangement together with the reduced dimension BH makes the replacement or retrofit of a water heater with a water heater with the blower assembly of the present invention simpler.

As shown in FIGS. 2-4, the center axis 64 of the blower housing output opening 52 may be radially offset a distance BOD from the center axis 56 of the heater exhaust opening 14. As shown in FIGS. 2-4 the distance BOD is zero.

As shown in FIGS. 2-4, a center axis 76 of the blower housing input opening 54 may be radially offset a distance BID from the center axis 56 of the heater exhaust opening 14. The motor shaft axis of rotation 66 may be radially offset a distance MD from the center axis 56 of the heater exhaust opening 14.

The interior 50 of the blower housing 48 and the cover plenum 32 serve as a portion of the exhaust gas flow path 36. The size and shape of the interior 50 of the blower housing 48 and the cover plenum 32 are chosen to obtain desired flow results.

For example, and as shown in FIGS. 2-4, the interior 50 of the blower housing 48 has an involute or spiral portion 78 and a duct portion 80. The interior may have a uniform cross section and have an interior height IH (see FIG. 2). The spiral portion 78 is defined by a dimension BHR extending from motor shaft axis of rotation 66 to interior wall 79 of blower housing that increases in the direction of arrow 82 (see FIG. 3).

For example, and as shown in FIG. 2-4, the plenum 32 formed by cap 22 may have any suitable size and shape to provide proper flow of exhaust gases 62 along the exhaust gas flow path 36. The plenum may have a uniform cross section and have an interior height PH (see FIG. 2). The cross section of the plenum may have any suitable shape and may as shown in dashed lines 88 to be oval with a length PL and width PW (see FIG. 3). The height PH, length PL and width PW should be chosen to provide ample are for the flow of gases 62 and to accommodate any tolerance variations during fabrication and assembly of the heater 12.

Referring to FIGS. 3 and 4, the cover 28 may be used for an end face of the blower housing 48. When so used, the blower housing 48 may have a blower housing periphery 90 (shown partially in phantom in FIG. 3) that is positioned within a cover periphery 92, so that the cover 28 may seal interior 50 of the blower housing 48. Alternatively, the cover periphery 92 may be aligned with the blower housing periphery 90. Fastener holes 94 near the blower housing periphery 92 may be used to permit fasteners (not shown) to secure the blower housing 48 to the cover 28.

The blower housing and the cover plenum may, if needed, include baffles or other restrictions (not shown) to increase the distance of the flow path 36 and to change pressure to slow the velocity of the flow to remove additional heat from the exhaust gases 62. Baffles or other restrictions 83 are typically positioned in water heater exhaust pipe or flue 84 where they serve to improve 37 heat transfer to the water.

The construction of the blower housing 48 and the cover plenum 32 of the cap 22 described above creates a winding exhaust gas flow path through the cap 22 and the blower housing 48. On operation of the motor 44 and rotation of the fan 46 in the blower housing 48, exhaust gases 62 are drawn axially through the water heater exhaust pipe or flue 84 and the exhaust opening 14. The exhaust gases 62 then travel radially from the water heater exhaust opening 14 toward the cover plenum 32 formed in cap 22. The exhaust gases 62 are then directed axially into the cover plenum 32. The exhaust gases 62 then travel radially outwardly across the cover plenum 32 toward the input opening 54 of the blower housing 14. The exhaust gases 62 then flows axially through the input opening 54 of the blower housing 14 toward the center of the rotating fan 46. The exhaust gases 62 are then pushed radially by the rotating fan 46 through the fan circumference of rotation across the spiral portion 78 of the interior 50 of housing 48 and toward the duct portion 80, i.e. the output opening 52 in the housing duct portion 80.

The exhaust gases 62 are then directed axially through the output opening 52. The winding flow path of the exhaust gases 62 through the blower housing 14 allows the gas to cool as it passes through the housing. In addition, the winding exhaust gas flow path through the blower housing 14 reduces stand-by losses of the water heater 26. To further reduce stand-by losses, the blower housing 48 could be modified with a damper (not shown) in the interior of the housing 48. The winding flow path of the exhaust gases 62 through the blower housing 48 is achieved inexpensively by the novel and non-obvious use of a cap recess to provide a cover plenum and to use the cover of the cap to form a portion of the blower housing.

The heater blower apparatus 12 of the invention described above, when equipped with a properly designed water heater can assist in obtaining an improved energy factor (EF) required in the United States. The heater blower apparatus 12 of the invention described above, when equipped with a properly designed water heater can use an existing vent pipe.

The heater blower apparatus 12 of the invention described above can replace current atmospheric draft hood water heaters, which cannot meet the improved energy factor (EF) required in the United States.

Figure 5:
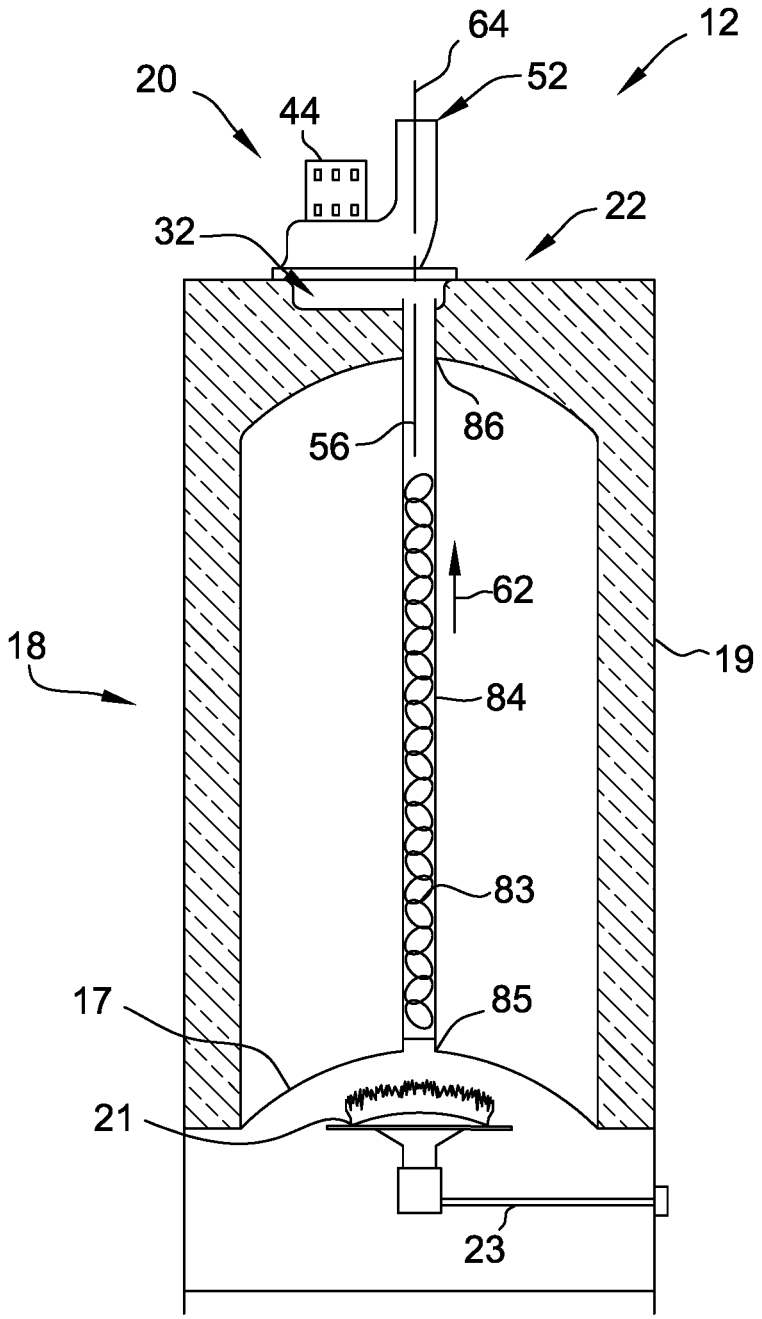
FIG. 5 is a plan view, partially in cross section, of the water heater of FIG. 2, showing some of the internal components of the water heater.

Referring now to FIG. 5, the water heater 12 is shown in greater detail. 2. The water heater 12 includes a water tank 18, a jacket 19 surrounding the water tank, a burner plenum 17 adjacent the water tank 18, a fuel burner 21 within the burner plenum 17, a fuel supply line 23, a flue 84, and a water heater blower assembly, generally indicated at 20. The fuel burner 21 is configured and adapted to combust fuel (e.g., natural gas, LP gas, etc.) to produce combustion products or exhaust gases 62. The flue 84 includes flue baffle 83 for providing a rigorous flow path through the flue 84. The flue 84 has an upstream end 85 and a downstream end 86. The upstream end 85 of the flue 84 is in fluid communication with the burner plenum 17. The flue 84 is configured for passage of combustion products from the burner plenum 17 through the water tank 18 and toward the downstream end 86 of the flue 84 to heat water within the water tank 18. The water tank 18 includes a water inlet and a water outlet (not shown) for introducing unheated water into the tank and for passage of heated water out of the tank, respectively.

The construction of the blower housing 14 with the recess described above also enables the water heater 12 to be assembled or retrofit to an existing water heater between the exhaust pipe and exhaust opening of the water heater and an axially aligned existing flue pipe.

Figure 6:
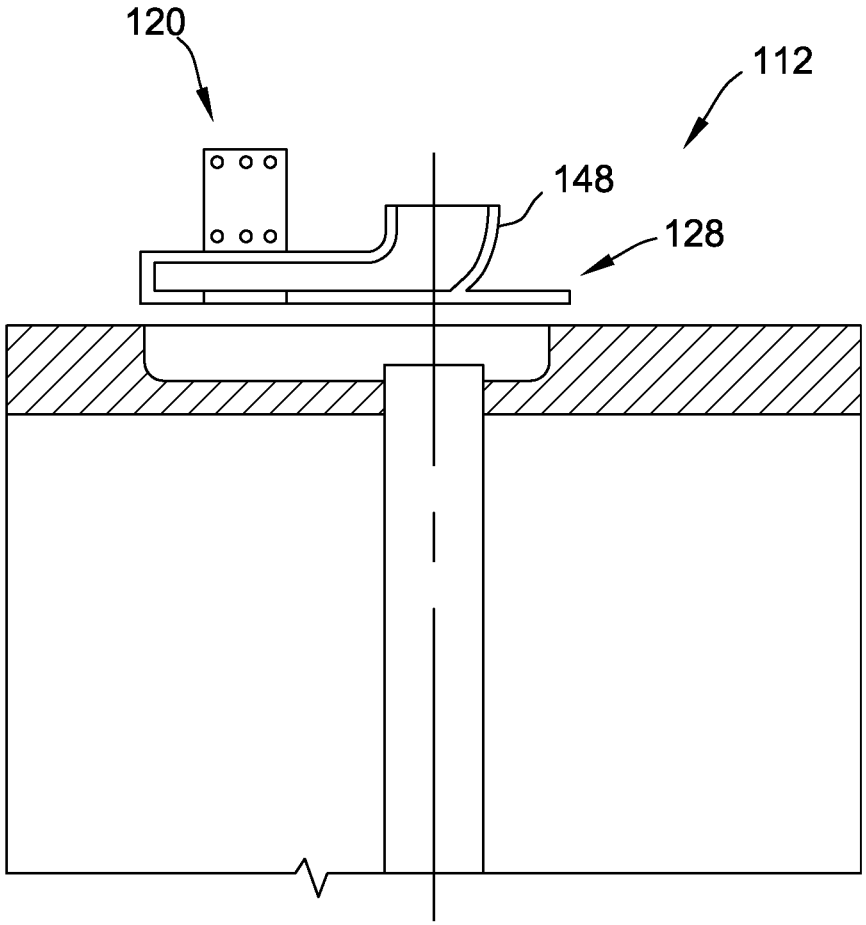
FIG. 6 is a partially exploded plan view, partially in cross section of a furnace blower assembly with a member integral with a furnace blower assembly, according to another embodiment of the present invention.

Referring now to FIG. 6 and according to another aspect of the present invention, a water heater 112 is shown. The water heater 112 is similar to the water heater 12 of FIGS. 1-5 except that the water heater 112 includes a heater blower assembly 120 that is different from the heater blower assembly 12 of FIGS. 1-5 in that the heater blower assembly 112 includes a heater blower housing 148 that includes member or cover 128. The cover 128 replaces the cover 28 of the water heater 12.

Figure 7:
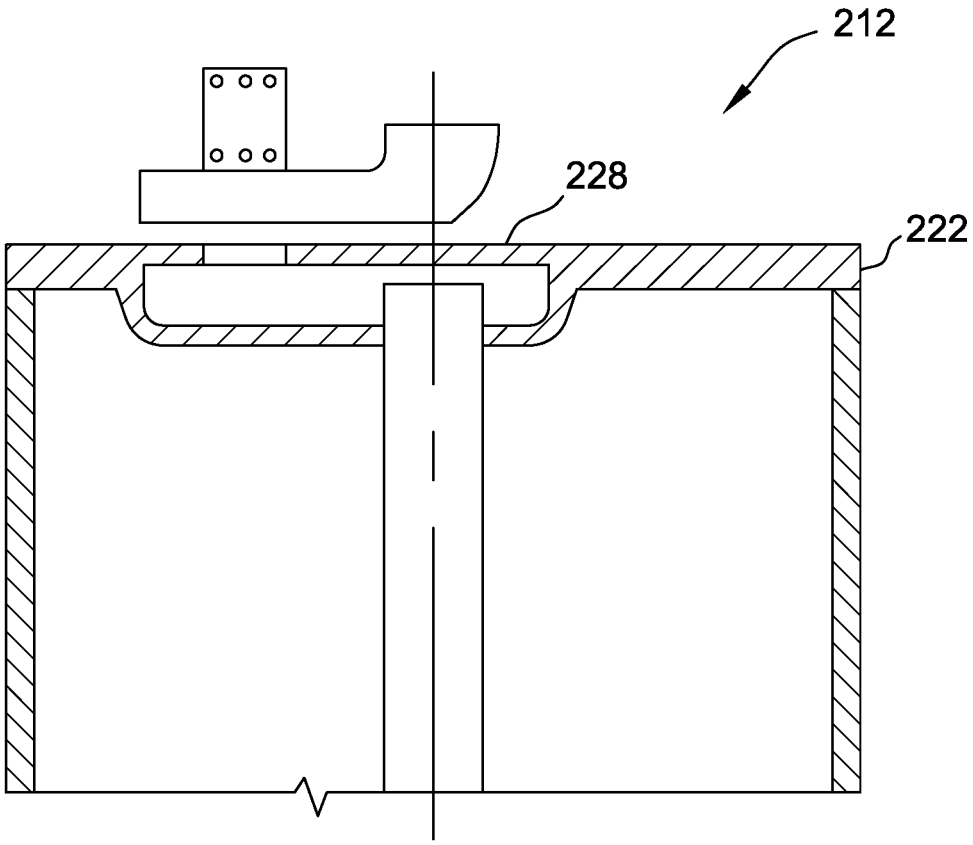
FIG. 7 is a partially exploded plan view, partially in cross section of a furnace blower assembly with a member integral with a cap, according to another embodiment of the present invention.

Referring now to FIG. 7 and according to another aspect of the present invention, a water heater 212 is shown. The water heater 212 is similar to the water heater 12 of FIGS. 1-5 except that the water heater 212 includes a tank cap 222 that is different from the tank cap 22 of FIGS. 1-5 in that the tank cap 222 includes member or cover 228. The cover 228 replaces the cover 28 of the water heater 12.

Figure 8:
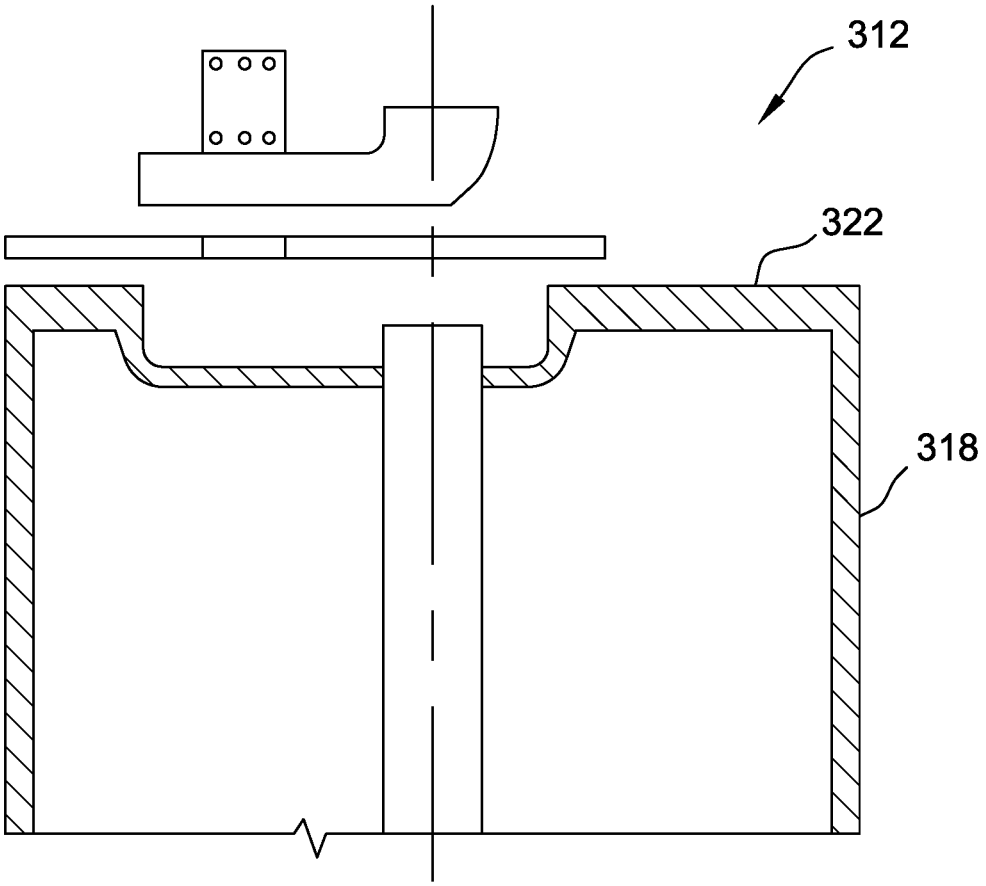
FIG. 8 is a partially exploded plan view, partially in cross section of a furnace blower assembly with a cap integral with a tank, according to another embodiment of the present invention.
Figure 9:
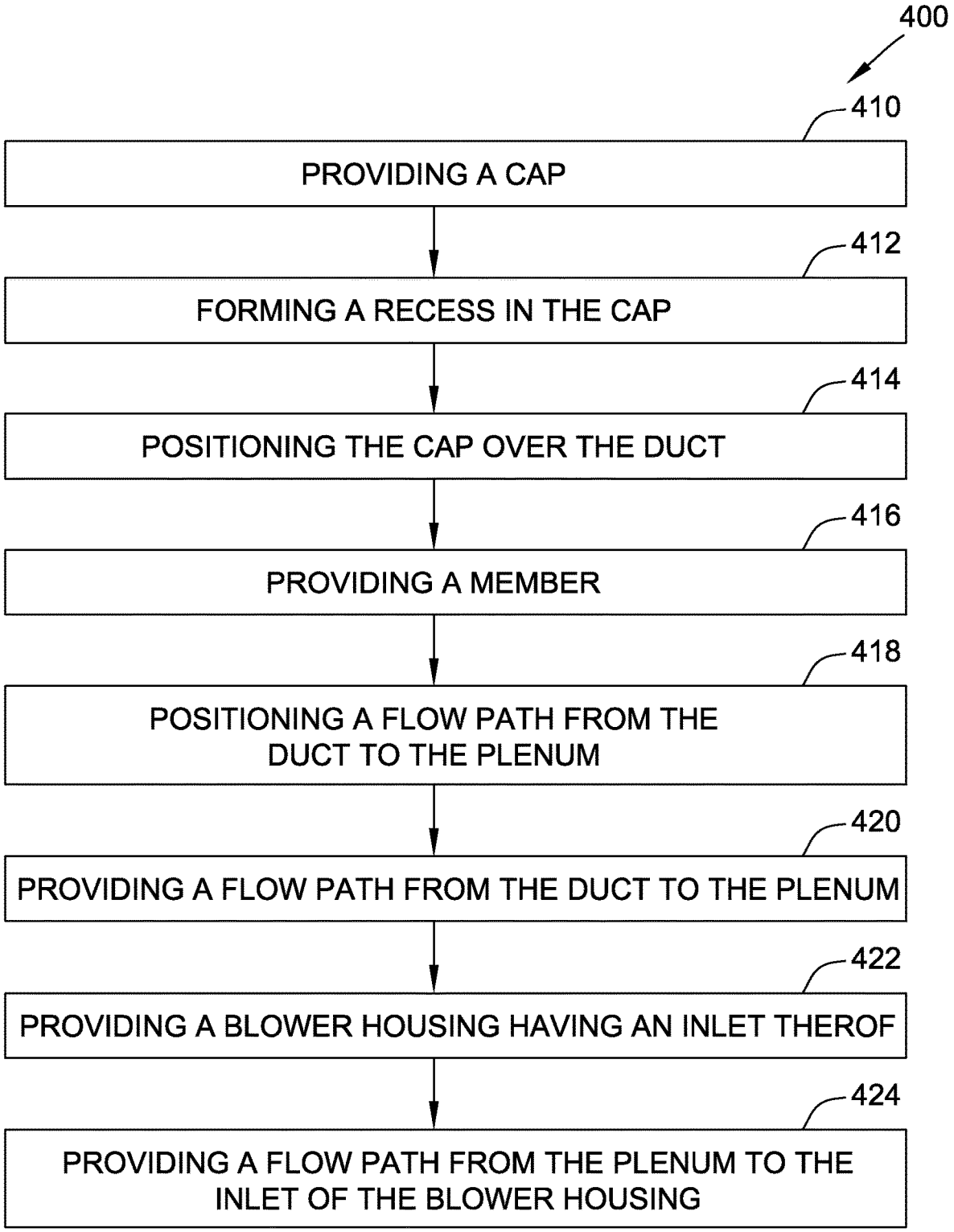
FIG. 9 is a flow chart of another embodiment of the present invention in the form of a method for sealing a furnace blower assembly.

Referring now to FIG. 8 and according to another aspect of the present invention, a water heater 312 is shown. The water heater 312 is similar to the water heater 12 of FIGS. 1-5 except that the water heater 312 includes a tank cap 322 that is different from the tank cap 22 of FIGS. 1-5 in that the tank cap 322 is integral with water heater tank 318.

According to another embodiment of the present invention, a method 400 for sealing a blower housing to a duct of a heater may be provided. The method includes step 410 of providing a cap, step 412 of forming a recess in the cap, step 414 of positioning the cap over the duct, step 416 of providing a member, step 418 of positioning the member over the cap to form a cover plenum from the recess between the cap and the member, step 420 of providing a flow path from the duct to the cover plenum, step 422 of providing a blower housing having an inlet thereof, and step 424 of providing a flow path from the cover plenum to the inlet of the blower housing.

The embodiments of the non-dilution blower apparatus were chosen and described in order to best explain the principles of the invention and its practical application to thereby enable others skilled in the art to best utilize the invention in various embodiments and with various modifications as are suited to the particular use contemplated.

As various modifications could be made in the constructions herein described and illustrated without departing from the scope of the invention, it is intended that all matter contained in the foregoing description or shown in the accompanying drawings shall be interpreted as illustrative rather than limiting. For example, the cap could be constructed of materials other than stamped or drawn sheet metal, and the blower housing with the cap having a recess to form a plenum could be employed on a heater other than a water heater. Thus, the breadth and scope of the present invention should not be limited by any of the above-described exemplary embodiments, but should be defined only in accordance with the following claims appended hereto and their equivalents.

When introducing elements/components/etc. of the methods and apparatus described and/or illustrated herein, the articles "a", "an", "the", and "the" are intended to mean that there are one or more of the element(s)/component(s)/etc. The terms "comprising", "including", and "having" are intended to be inclusive and mean that there may be additional element(s)/component(s)/etc. other than the listed element(s)/component(s)/etc.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

Described herein are exemplary methods, systems and apparatus utilizing a heater cap to provide a plenum for assisting air flow for a blower. Furthermore, the exemplary methods system and apparatus achieve improved performance and reduced cost. The methods, system and apparatus described herein may be used in any suitable application. However, they are particularly suited for water heater applications.

Exemplary embodiments of the cap, blower, heater and methods are described above in detail. The heater its components are not limited to the specific embodiments described herein, but rather, components of the systems may be utilized independently and separately from other components described herein. For example, the components may also be used in combination with other machine systems, methods, and apparatuses, and are not limited to practice with only the systems and apparatus as described herein. Rather, the exemplary embodiments can be implemented and utilized in connection with many other applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A water heater assembly having an exhaust opening on the exterior surface of the water heater with the exhaust opening having a center axis that defines mutually perpendicular axial and radial directions relative to the water heater and advances exhaust gases from the water heater to an exterior environment, the assembly comprising:

a water heater having a tank, the water heater comprising a side wall and a tank cap located above the side wall, the side wall and the tank cap together defining an exterior surface of an upper portion of the water heater, said tank cap having a recess surface formed in the exterior surface thereof and configured to extend inwardly toward the water heater in the axial direction of the exhaust opening, wherein said recess surface is below the exterior surface of the tank cap, wherein said recess surface extends only partially along said exterior surface of the tank cap, and wherein said exterior surface comprises the uppermost surface of said tank cap;

a member defining a first surface thereof and connected to said exterior surface of said tank cap to form a cover plenum between the recess surface of said tank cap and the first surface of said member, wherein said cover plenum is below the exterior surface of the tank cap, said member defining an output opening of said member that communicates with the cover plenum; and a blower connected to the member, the blower including:

a motor;

a fan connected to the motor for rotation of the fan with rotation of the motor; and a blower housing having an interior containing the fan, the motor being supported by the blower housing, the blower housing having an output opening having a center axis that defines mutually perpendicular axial and radial directions and that communicates the blower housing interior with the exterior environment, the blower housing further having an input opening that communicates the blower housing interior with the member output opening, wherein said blower input opening is axially aligned with and spaced axially above said member output opening, wherein the blower housing, the member and the tank cap are configured to provide an exhaust gas flow path from the exhaust opening of the heater through the cover plenum, through the blower housing interior and out the output opening.

2. The water heater assembly of claim 1; wherein the fan is connected to the motor by a motor shaft extending from the motor; and wherein the center axis of the blower housing output opening is substantially parallel to and spaced radially from the axis of rotation of the motor shaft and the fan axis of rotation, wherein the output opening is positioned axially above the heater exhaust opening when the blower housing is attached to the member.

3. The water heater assembly of claim 1, further comprising: the blower housing attached to the member to prevent dilution air from entering the blower housing interior.

4. The water heater assembly of claim 1, further comprising the blower housing being attached to the member with the blower housing sealing around the member and thereby providing a non-dilution air blower housing on the water heater.

5. The water heater assembly of claim 1, further comprising the interior structure of the blower housing including an interior wall that extends radially through the blower housing interior and is positioned axially between the water heater exhaust opening and the blower housing output opening when the blower housing is attached to the member.

6. The water heater assembly of claim 5, further comprising: the interior wall having an opening through the interior wall that is spaced radially and axially from the blower housing output opening and is spaced radially and axially from the water heater exhaust opening when the blower housing is attached to the member, wherein said interior wall opening defines said blower input opening.

7. The water heater assembly of claim 6, further comprising: the exhaust gas flow path passing through the interior wall opening.

8. The water heater assembly of claim 6, further comprising: the interior wall opening being axially aligned with the fan axis of rotation.

9. The water heater assembly of claim 6, further comprising the fan being positioned on one side of the interior wall and the water heater exhaust opening being positioned on an opposite side of the interior wall when the blower housing is attached to the member.

10. The water heater assembly of claim 2, further comprising:

the motor shaft axis of rotation and fan axis of rotation being substantially coaxial and substantially parallel to the blower housing output opening center axis and the water heater exhaust opening center axis.

11. The water heater assembly of claim 5, further comprising:

the interior wall having an opening with a center axis that is substantially coaxial with the fan axis of rotation.

* * * * *